United States Patent [19]

Faxon

[11] 4,170,117

[45] Oct. 9, 1979

[54] MIST SPRAY APPARATUS FOR AIR CONDITIONER CONDENSER

[76] Inventor: Robert L. Faxon, 708 N. Spring St., Pensacola, Fla. 32501

[21] Appl. No.: 832,923

[22] Filed: Sep. 13, 1977

[51] Int. Cl.[2] ..... F25B 39/04; F28D 5/00

[52] U.S. Cl. ..... 62/183; 62/305; 248/302

[58] Field of Search ..... 248/302; 62/183, 181, 62/184, 305; 24/73 HL, 73 HH, 84 A, 81 AA, 81 A

[56] References Cited

U.S. PATENT DOCUMENTS

| | | | |
|---|---|---|---|
| 948,672 | 2/1910 | Muller | 248/302 X |
| 1,277,476 | 9/1918 | Plopper | 248/302 |
| 1,483,255 | 2/1924 | Tonge | 24/73 HH |
| 1,957,353 | 5/1934 | Piersall | 248/302 X |
| 2,121,115 | 6/1938 | Bergdoll | 62/305 X |
| 2,185,033 | 12/1939 | Melcher | 62/183 X |
| 2,185,965 | 1/1940 | Newill | 62/183 X |
| 2,187,398 | 1/1940 | Goggins | 62/305 |
| 2,238,808 | 4/1941 | Dube et al. | 62/181 |
| 2,278,242 | 3/1942 | Chapman | 62/171 |
| 2,370,406 | 2/1945 | King | 24/73 HH |
| 2,599,849 | 6/1952 | Lenz | 248/302 X |
| 2,651,182 | 9/1953 | Borgerd | 62/183 X |
| 2,664,715 | 1/1954 | Borgerd | 62/305 X |
| 2,713,470 | 7/1955 | Bodnar | 248/302 |
| 2,817,959 | 12/1957 | Lustwerk et al. | 62/305 |
| 2,817,960 | 12/1957 | Lustwerk et al. | 62/156 |
| 2,911,801 | 11/1959 | Buehler, Jr. | 62/305 |
| 2,938,358 | 5/1960 | Newton et al. | 62/305 X |
| 3,130,557 | 4/1964 | McFarlan | 62/305 X |
| 3,370,816 | 2/1968 | Michaud | 248/302 |
| 3,613,392 | 10/1971 | Di Tucci | 62/305 X |
| 3,635,046 | 1/1972 | Sato et al. | 62/305 |
| 3,783,635 | 1/1974 | Perez | 62/276 |
| 3,851,702 | 12/1974 | Heller et al. | 62/305 X |
| 4,028,906 | 6/1977 | Gingold et al. | 62/183 |
| 4,061,482 | 12/1977 | Smith | 62/180 X |

*Primary Examiner*—Leslie Braun

*Attorney, Agent, or Firm*—Jacox & Meckstroth

[57] ABSTRACT

Apparatus for attachment to an air conditioner condenser for applying a mist of water or other liquid to the coils and fins of the condenser to improve the heat transfer capability of the condenser. The apparatus includes a spray nozzle, support means for the spray nozzle, fluid conductors, a fluid valve member, temperature sensing means, and a valve control member. The temperature sensing means, through the valve control member, causes the spray to operate only when certain predetermined temperature conditions exist.

2 Claims, 5 Drawing Figures

MIST SPRAY APPARATUS FOR AIR CONDITIONER CONDENSER

BACKGROUND OF THE INVENTION

Heat transfer between a fluid conductor or heat exchange member and the atmosphere can be improved by water or other liquid in contact with the surface of the heat exchange member. Due to the fact that water absorbs heat only on the outer surface of droplets thereof, a multiplicity of droplets of very small size provides better heat transfer than larger droplets which are fewer in number.

It is therefore an object of this invention to provide means for automatic application of liquid in the form of a fine mist to the heat exchange portion of an air conditioner condenser in accordance with the temperature of the heat exchange portion.

Another object of this invention is to provide such apparatus which can be easily and readily installed or attached to any "Freon" charged type of air conditioner condenser.

Another object of this invention is to provide support means for a spray nozzle so that the spray nozzle can be positioned at any desired location to spray a mist of liquid upon the heat transfer members of a condenser of an air conditioner unit.

Another object of this invention is to provide such apparatus which is relatively low in cost and which is long-lived.

Other objects and advantages of this invention reside in the construction of parts, the combination thereof, the method of manufacture, and the mode of operation, as will become more apparent from the following description.

SUMMARY OF THE INVENTION

The apparatus of this invention includes means for easy attachment of a spray nozzle to a condenser of an air conditioner and for properly positioning the spray nozzle with respect to the heat exchange portion of the condenser. The apparatus also includes a fluid conduit member for flow of fluid to the spray nozzle and a fluid valve for control of fluid in the fluid conduit member. The apparatus also includes a thermostat positionable in engagement with the heat transfer portion of the condenser for sensing the temperature thereof. The thermostat is joined to a control member which controls operation of the fluid valve.

DESCRIPTION OF THE PREFERRED EMBODIMENT

Figure 1:
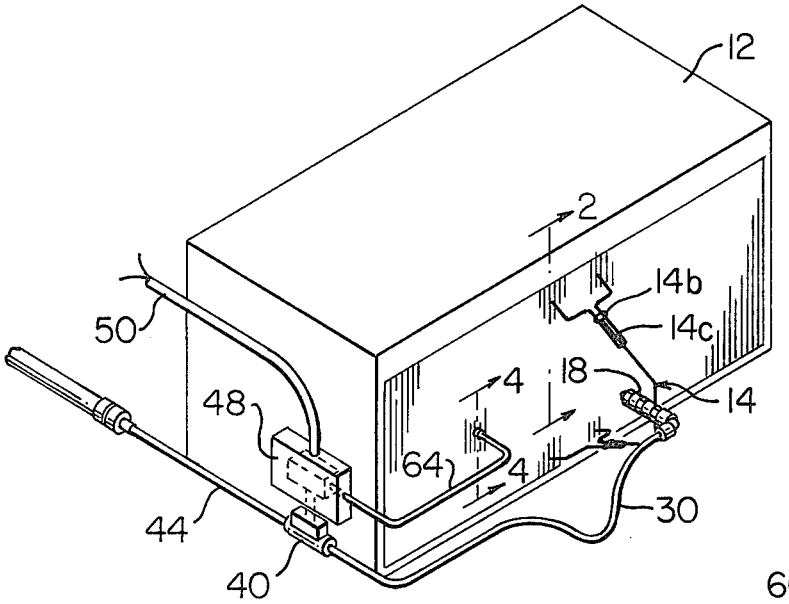
FIG. 1 is a perspective view of a condenser of an air conditioner, showing the apparatus of this invention in association therewith.
Figure 2:
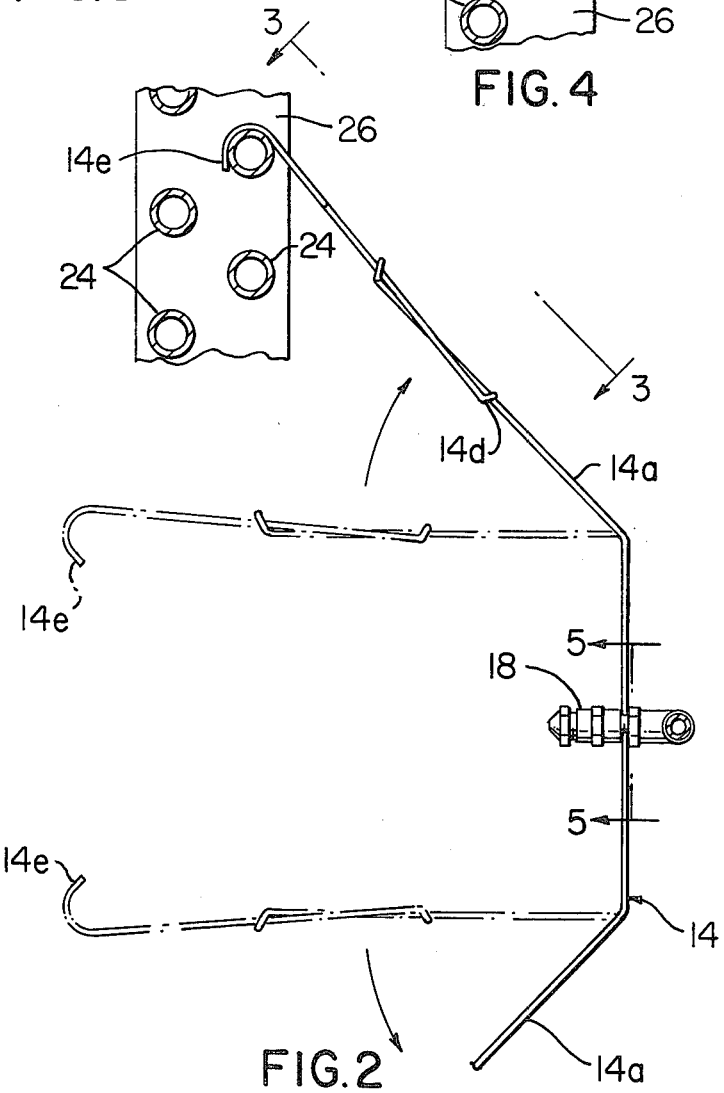
FIG. 2 is an enlarged fragmentary sectional view taken substantially on line 2—2 of FIG. 1.
Figure 5:
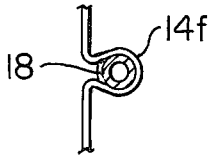
FIG. 5 is a fragmentary sectional view taken substantially on line 5—5 of FIG. 2.

A condenser member 12 of an air conditioner unit is shown in FIG. 1. A hanger assembly 14 supports a spray nozzle member 18 and attaches the spray nozzle member 18 to the condenser 12. The hanger assembly 14 comprises an elongate base 14*a*, provided with a loop 14*b* at each end thereof. A resilient U-shaped stem 14*c* extends through each of the loops 14*b*. Each U-shaped stem 14*c* has an arcuate end portion 14*d* which engages the elongate base 14*a*. The U-shaped stem 14*c* has a pair of spaced-apart hooks 14*e* at the end thereof. The hooks 14*e* are adapted to hook over a fluid conductor, such as a fluid conductor 24 of the condenser 12, for support of the hanger assembly 14. The elongate base 14*a* may be bent as desired, as illustrated in FIG. 2 so that the spaced-apart hooks 14*e* may be positioned as desired upon conductors 24. The conductors 24 are shown as having fins 26 as an integral part thereof. The hooks 14*e* are forced into position between adjacent fins 26. The resiliency of the stem 14*c* within the loop 14*b* and the engagement of the arcuate end portion 14*d* with the base 14*a* retains the U-shaped stem 14*c* in desired position with respect to the base 14*a* when the hooks 14*e* are in engagement with fluid conductors 24.

The elongate base 14*a* has an arcuate clamp portion 14*f* at the central portion thereof which partially encompasses the spray nozzle member 18 for support thereof and to retain the spray nozzle member 18 in position to direct a spray upon the fluid conductors 24 and fins 26.

A fluid hose or pipe 30 is attached to the spray nozzle member 18 for flow of fluid thereto. The fluid hose or pipe 30 is joined to an electrically operable fluid valve 40. An inlet hose or pipe 44 is attached to the fluid valve 40 to provide fluid from a source thereof.

As shown in FIG. 1, the electrically operable fluid valve 40 is electrically connected to a control unit 48. Electric conductors 50 are adapted to be joined to a source of electrical energy and are also joined to the control unit 48.

Figure 4:
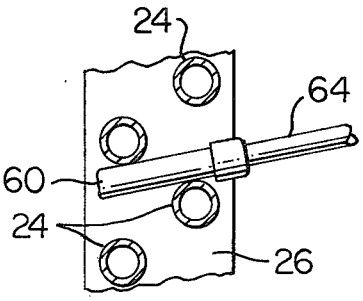
FIG. 4 is an enlarged fragmentary sectional view taken substantially on line 4—4 of FIG. 1.
Figure 3:
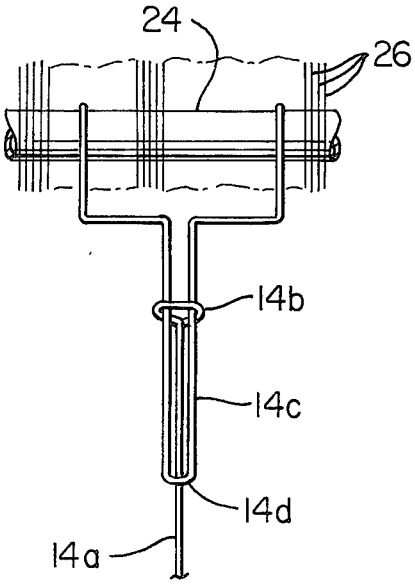
FIG. 3 is a fragmentary sectional view taken substantially on line 3—3 of FIG. 2.

A temperature sensing member 60, best shown in FIG. 4, is positioned in engagement with at least one of the fluid conductors 24 in the condenser 12 and has a conductor 64 extending therefrom to the control unit 48. The temperature sensing member 60 is tightly positioned among fins 26, some of which are bent slightly to receive the temperature sensing member 60.

Operation

During operation of the air conditioner system of which the condenser 12 is a part, fluid, such as "Freon", carrying heat from the region cooled by the air conditioner system flows into the condenser 12 and through the fluid conductors 24 thereof at a lower pressure than in other parts of the system. Heat from within the fluid in the conductors 24 of the condenser 12 is transferred to the atmosphere as the fluid flows through the conductors 24. The amount of heat transferred to the atmosphere is related to the heat transfer characteristics and capability of the fluid conductors 24 and the fins 26.

Thermal conductivity of the conductors 24 and fins 26 is increased when water or other fluid is in engagement with the conductors 24 and fins 26. The heat transfer characteristics are also related to the size of the droplets of water on the surface of the conductors 24 and fins 26.

The apparatus of this invention applies a mist of very small droplets of water to the conductors 24 and fins 26 when a predetermined temperature exists in the fluid conductors 24. The temperature sensing member 60 senses the temperature of the fluid conductors 24 and transmits information regarding that temperature through the conductor 64 to the control unit 48. When the temperature of the conductors 24 reaches a predetermined magnitude, the control unit 48 operates the electrically operable fluid valve 40 and permits water to flow through the pipe or hose 30 to the spray nozzle member 18. Thus, a mist type of spray is applied to the conductors 24 and fins 26. The droplets of water upon the conductors 24 and fins 26 improve the heat transfer capability thereof, and the temperature of the fluid in the conductors 24 is reduced. The time involved in reducing the temperature of the fluid in the conductors 24 depends upon many factors, including atmospheric conditions. When this reduction in temperature of the fluid occurs, the temperature of the conductors 24 is reduced, and the decrease in temperature is sensed by the temperature sensing member 60 and transmitted to the control unit 48. When the temperature sensed by the temperature sensing member 60 decreases to a predetermined magnitude, the control unit 48 operates to close the fluid valve 40, and water ceases to flow to the spray nozzle member 18. Thus, the mist spray to the conductors 24 and fins 26 ceases.

Therefore in this process, the mist spray upon the conductors 24 and fins 26 occurs only during the time that the temperature of the fluid in the conductors 24 is above a predetermined magnitude. Thus, the apparatus of this invention increases heat transfer from the fluid in the conductors 24 during the period of time that the fluid is above the predetermined temperature.

It is to be understood that the apparatus of this invention may comprise a plurality of support members and spray nozzle members. The support members may be attached to or supported by the condenser in a manner different from that illustrated. For example, the support members may be supported by the protective grill of a condenser or by any other portion of the condenser or by means adjacent the condenser.

Although the preferred embodiment of the mist spray apparatus for an air conditioner condenser of this invention has been described, it will be understood that within the purview of this invention various changes may be made in the form, details, proportion and arrangement of parts, the combination thereof, and the mode of operation, which generally stated consist in a mist spray apparatus for air conditioner condenser within the scope of the appended claims.

The invention having thus been described, the following is claimed.

1. Apparatus for applying a liquid mist to the heat exchange portion of a condenser of an air conditioner system, the heat exchange portion of the condenser having fluid conductors with fins attached thereto, and provided with a spray nozzle member, fluid conduit means joined to the spray nozzle member for supplying fluid thereto, comprising:

a support member attachable to the condenser for support of the support member by the condenser, the support member including connector means for connection to the spray nozzle member for support thereof, the support member retaining the spray nozzle member in position to spray liquid upon the fluid conductors and fins of the heat exchange portion, said support member including an elongate base portion provided with a loop at each end thereof, a plurality of U-shaped stems, there being a U-shaped stem slidably extending through each loop and adjustable with respect thereto, each U-shape stem having a pair of hooks, the hooks being adapted to hook over a fluid conductor for support of the support member, an electrically operable fluid valve member joined to the fluid conduit means for control of fluid flow into the fluid conduit means, control means joined to the electrically operable fluid valve member for operation thereof, a temperature sensing member in engagement with a portion of the fluid conductors and fins of the heat exchange portion of the condenser to sense the temperature thereof, and means joining the temperature sensing member to the control unit for operation of the electrically operable fluid valve member in accordance with the temperature of said fluid conductors and fins of the heat exchange portion of the condenser.

2. Mist spray apparatus for an air conditioner system provided with a condenser having a plurality of fluid conductors, the improvement comprising:

a support member including an elongate base, a pair of U-shaped stems attached to the elongate base and adjustable with respect thereto, each of the U-shape stems having a pair of hooks adapted to be hooked over at least one fluid conductor for support of the support member, a mist spray nozzle member attached to the support member for support thereby, a fluid conduit member joined to the mist spray nozzle member for conducting fluid thereto, an electrically operable fluid valve member joined to the fluid conduit member for controlling flow of fluid into the fluid conduit member, a temperature sensing member in engagement with a fluid conductor to sense the temperature thereof, and means joining the temperature sensing member to the electrically operable fluid valve member for operation of the fluid valve member in accordance with the temperature of the fluid conductor.

* * * * *